US010724356B2

(12) United States Patent
McCoy

(10) Patent No.: US 10,724,356 B2
(45) Date of Patent: Jul. 28, 2020

(54) CENTRIFUGAL FORCE DOWNHOLE GAS SEPARATOR

(71) Applicant: James N. McCoy, Wichita Falls, TX (US)

(72) Inventor: James N. McCoy, Wichita Falls, TX (US)

( * ) Notice: Subject to any disclaimer, the term of this patent is extended or adjusted under 35 U.S.C. 154(b) by 75 days.

(21) Appl. No.: 16/124,323

(22) Filed: Sep. 7, 2018

(65) Prior Publication Data

US 2020/0080408 A1 Mar. 12, 2020

(51) Int. Cl.
*E21B 43/38* (2006.01)

(52) U.S. Cl.
CPC ..... *E21B 43/38* (2013.01)

(58) Field of Classification Search
CPC ..... E21B 43/38
See application file for complete search history.

(56) References Cited

U.S. PATENT DOCUMENTS

| | | | |
|---|---|---|---|
| 1,628,900 | A | 5/1926 | Neilsen |
| 3,867,056 | A | 2/1975 | Carle et al. |
| 4,481,020 | A | 11/1984 | Lee et al. |
| 4,531,584 | A | 7/1985 | Ward |
| 5,431,228 | A | 7/1995 | Weingarten et al. |
| 5,482,117 | A | 1/1996 | Kolpak |
| 6,283,204 | B1 | 9/2001 | Brady |
| 6,382,317 | B1 | 5/2002 | Cobb |
| 6,394,182 | B1 | 5/2002 | Fadel |
| 6,494,258 | B1 | 12/2002 | Weingarten |
| 6,705,402 | B2 | 3/2004 | Proctor |
| 6,755,250 | B2 | 6/2004 | Hall et al. |
| 6,932,160 | B2 | 8/2005 | Murray et al. |
| 7,883,570 | B2 | 2/2011 | Obrejanu |
| 9,004,166 | B2 | 4/2015 | Raglin |
| 9,249,653 | B1 | 2/2016 | Botts |
| 9,353,614 | B2 | 5/2016 | Roth et al. |
| 9,359,879 | B2 | 6/2016 | Gill et al. |
| 9,771,786 | B2 | 9/2017 | Raglin |
| 2011/0048696 | A1 | 3/2011 | Holte |
| 2013/0259721 | A1 | 10/2013 | Nabil-Mehidi et al. |
| 2016/0130922 | A1* | 5/2016 | Wilson ..... E21B 43/128 166/369 |
| 2017/0107807 | A1 | 4/2017 | Saponja et al. |

* cited by examiner

*Primary Examiner* — Brad Harcourt
(74) *Attorney, Agent, or Firm* — Dale B. Nixon

(57) ABSTRACT

A downhole separator performs the function of removing gas from liquids before the liquids enter the well pump. The formation fluid enters into a first, lower, chamber, of the separator and exits through channels to helical passageways on the exterior of the separator body. A shroud surrounds the separator body to serve as an outer wall of the helical passageways. Spiraling movement of the fluid forces the heavier liquids outward and causes separation of the lighter gas. The liquids and gas are ejected from the top of the separator body. The separated liquids drain downward by gravity pull to a liquid reservoir. Liquids in the reservoir are driven upward and flow through channels on the exterior of the separator body into a second, upper chamber, in the separator body which is coupled by tubing to the inlet of the pump.

16 Claims, 9 Drawing Sheets

CENTRIFUGAL FORCE DOWNHOLE GAS SEPARATOR

BACKGROUND

1. Field of the Invention

The present invention relates to the production of hydrocarbons from a borehole well and in particular to the downhole separation of liquid and gas in the production stream from the well.

2. Description of the Related Art

In the production of oil from underground formations, the fluid from the formation typically contains not only hydrocarbon oil, but also gas and water. Some of the gas can be combined with the water and oil. The majority of wells today do not have sufficient formation pressure to drive the fluid to the surface, therefore production from the wells requires the use of a downhole pump. In many cases the pump can effectively lift liquids to the surface, but if the formation fluid includes a significant amount of gas, the operation of the pump can be impeded because the gas displaces the liquids in the pump. This not only can reduce the amount of liquid produced from the well, it can also damage the equipment. To reduce this problem, the industry has developed a wide variety of devices and techniques to separate the gas from the liquids before the liquids enter the pump. These devices are typically referred to as "downhole gas separators". There are multiple designs for these devices, but gas separation is a difficult problem which has not been solved, and therefore there is a need for a more effective method and apparatus for downhole gas separation.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
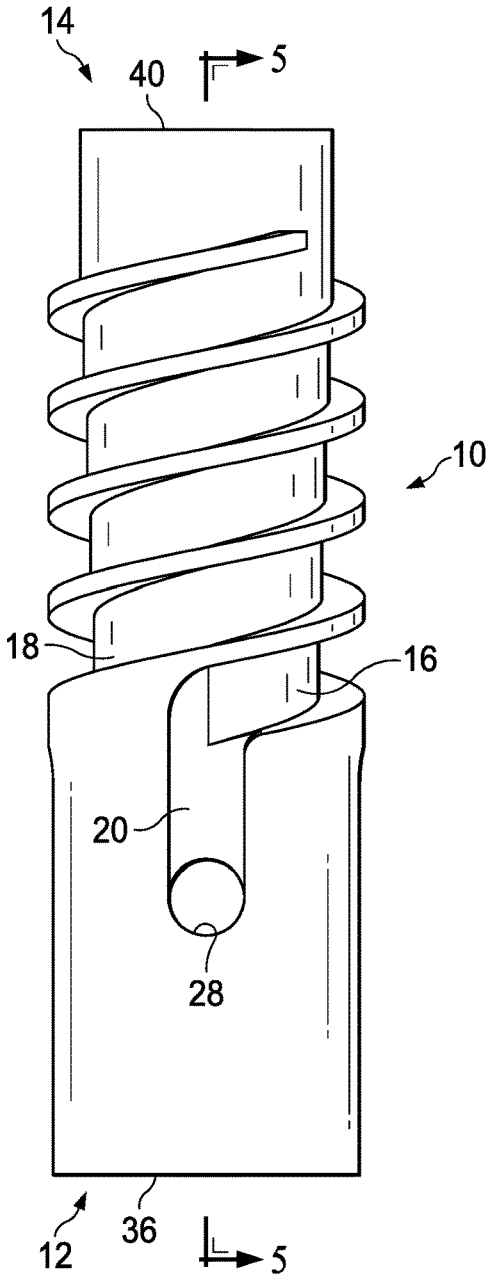
FIG. 1 is an elevation view of a gas separator body having two intertwined helical grooves.
Figure 2:
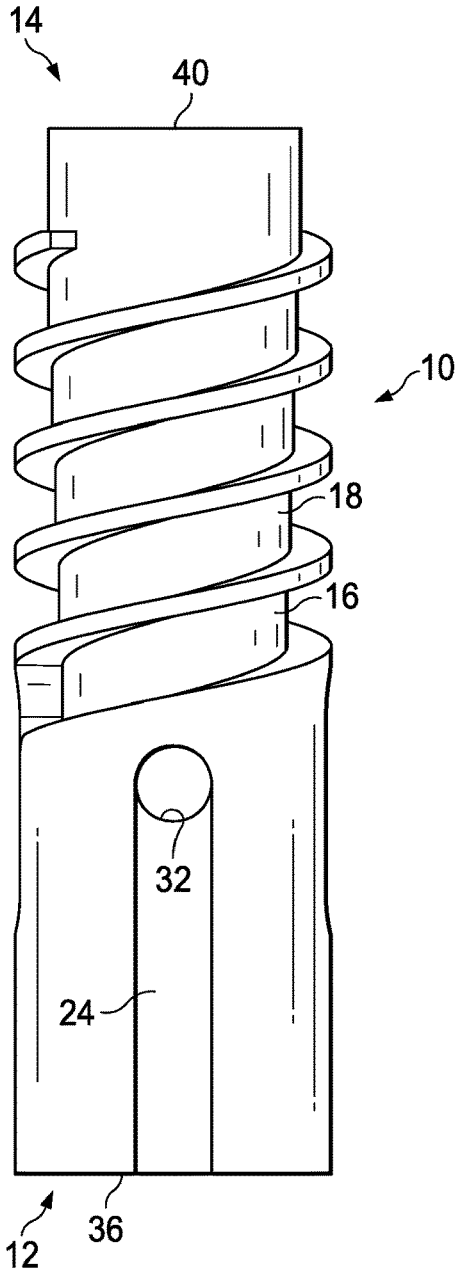
FIG. 2 is an elevation view of the separator body shown in FIG. 1 rotated axially by 90 degrees relative to the position shown in FIG. 1.
Figure 3:
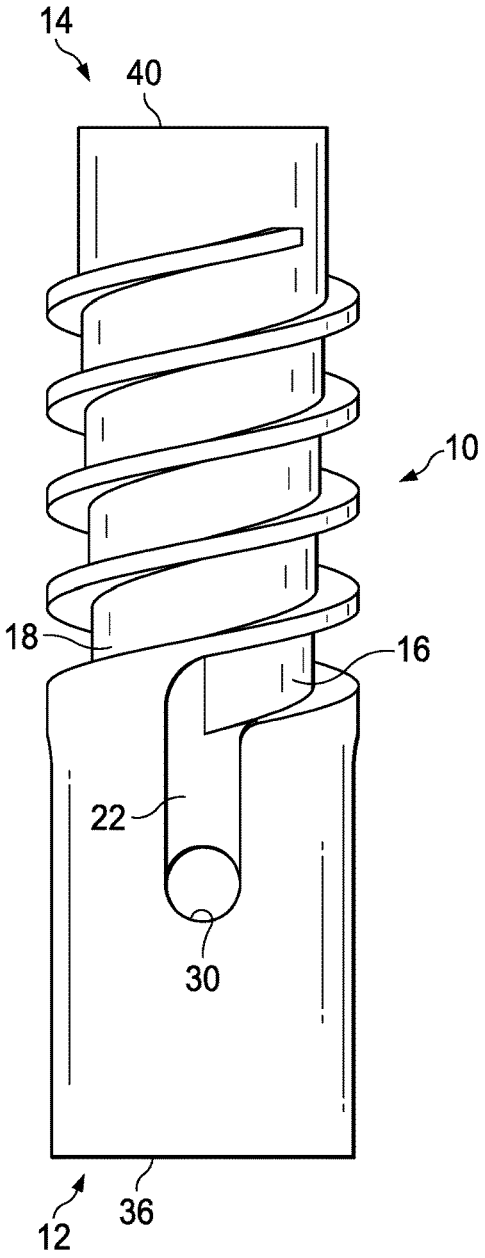
FIG. 3 is an elevation view of the separator body shown in FIG. 1 rotated axially by 180 degrees relative to the position shown in FIG. 1.
Figure 4:
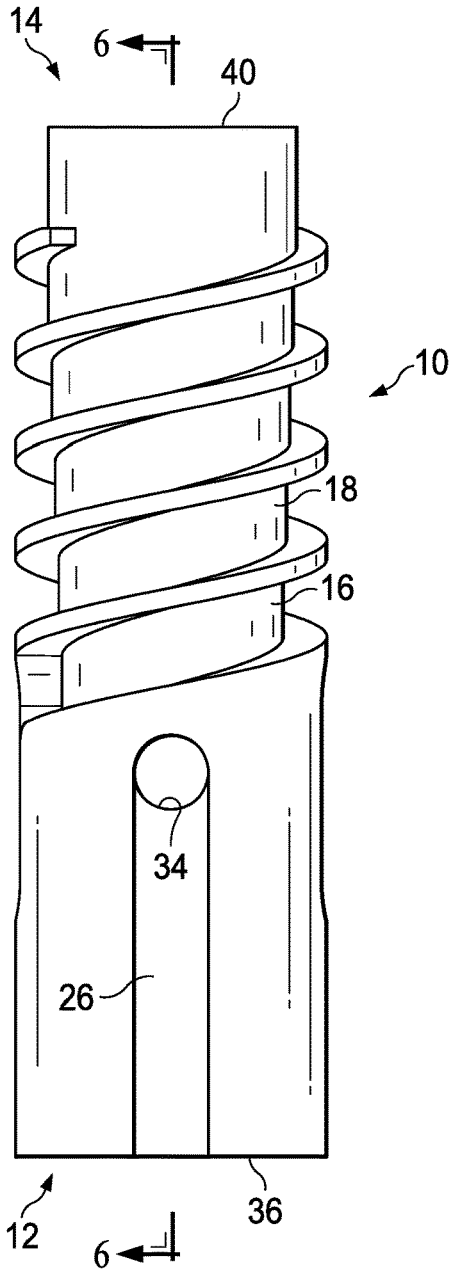
FIG. 4 is an elevation view of the separator body shown in FIG. 1 rotated axially by 270 degrees relative to the position shown in FIG. 1.

Referring to FIGS. 1-4, there is shown a gas separator body 10 which has a first end 12 at the bottom of the figures and a second end 14 at the top of the figures. The body 10 has intertwined external helical grooves 16 and 18. The body 10 has a first exterior slot 20 (FIG. 1) and a second diametrically opposed exterior slot 22 (FIG. 3). The body 10 further has a third exterior slot 24 (FIG. 2) and a diametrically opposed exterior slot 26 (FIG. 4). The body 10 includes an opening 36 (FIG. 1) extending down to the first end 12. The body 10 has interior pipe threads 38 (see FIG. 8) adjacent to the opening 36. The body 10 also has an opening 40 (FIGS. 1-4) at the second (top) end 14. The body 10 has interior pipe threads 42 (see FIG. 7) adjacent to the opening 40.

The separator body 10, as shown in FIGS. 1 and 3 has holes 28 and 30 which pass from corresponding slots 20 and 22 to a lower interior chamber 52 (see FIGS. 5 and 6) of the separator body 10. The separator body 10, as shown in FIGS. 2 and 4 has holes 32 and 34 which pass from corresponding slots 24 and 26 to an upper interior chamber 54 (see FIGS. 5 and 6) of the separator body 10.

Figure 7:
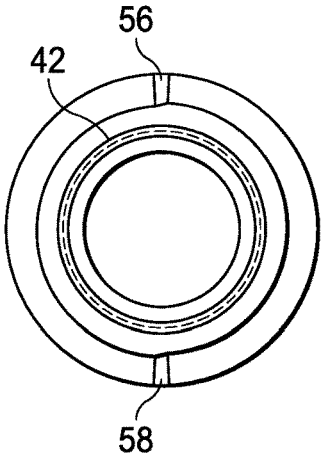
FIG. 7 is a top view of the separator body shown in FIGS. 1-4.

Further referring to FIG. 1 and FIG. 3, the slot 20 connects to the helical groove 16 and the slot 22 connects to the helical groove 18. Each of the helical grooves has an open end at the second end 14 of the separator body 10. The helical grooves 16 and 18 are intertwined and their open ends, at terminations 56 and 58, as shown in FIG. 7, are on diametrically opposed sides of the separator body 10 at end 14. The pipe threads 38 and 42 serve for connecting the separator body 10 to sections of pipe having corresponding threaded ends.

Figure 5:
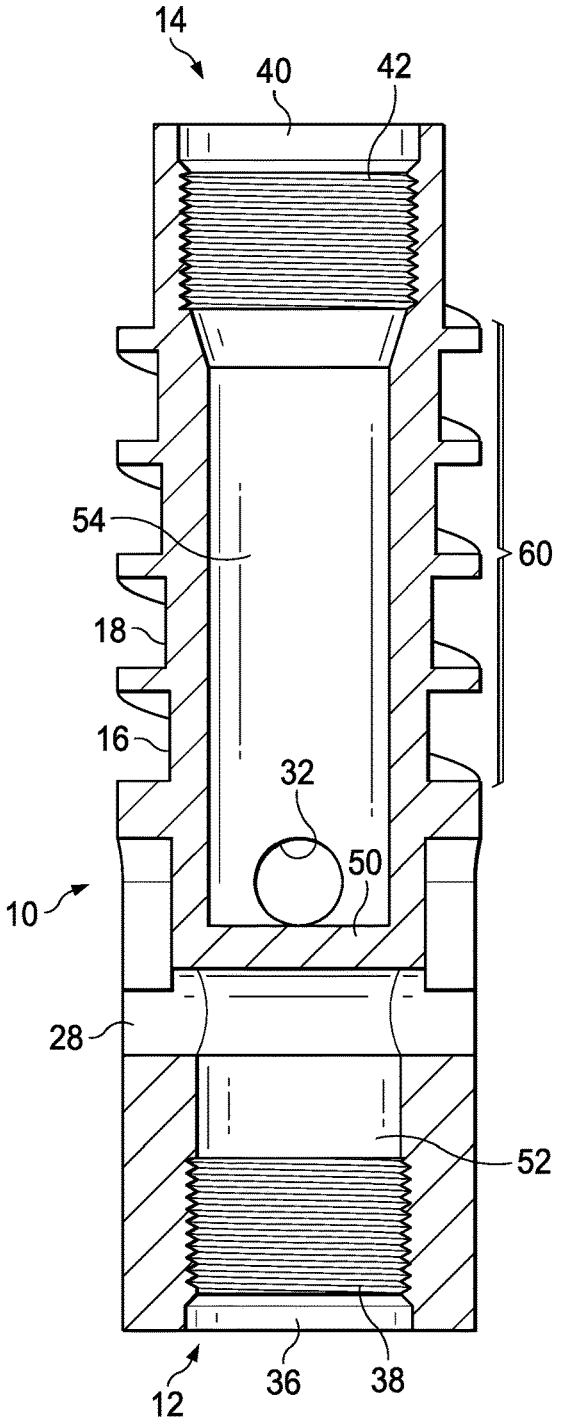
FIG. 5 is a section view of the separator body shown in FIG. 1 taken along lines 5-5.

Referring to FIG. 5, there is shown a section view of the separator body 10 as illustrated in FIG. 1 along lines 5-5.

Figure 6:
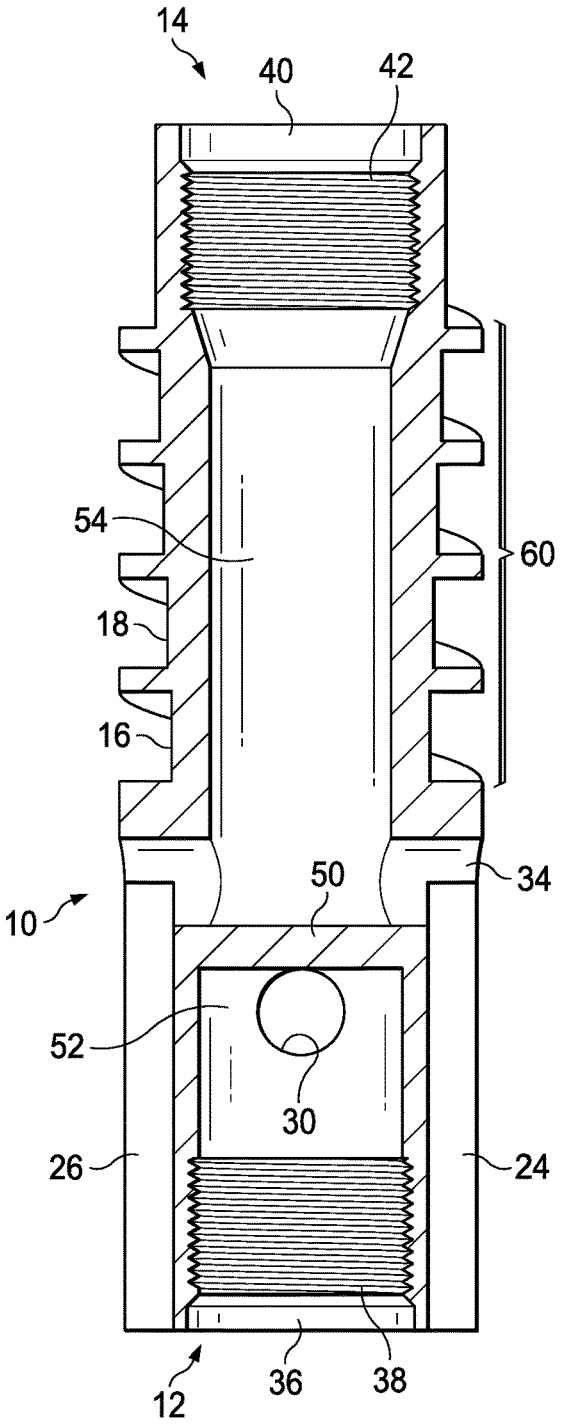
FIG. 6 is a section view of the separator body shown in FIG. 4 taken along the lines 6-6.

FIG. 6 illustrates a cross-section view of the separator body 10 taken along lines 6-6 along the length of separator body 10 shown in FIG. 4. Hole 30 opens into slot 22. The interior of the separator body 10 has a solid barrier 50 (FIGS. 5 and 6) which divides the interior volume of the separator body 10 into the first chamber 52 open to opening 36 at the first end 12 and the second chamber 54 open to opening 40 at the second end 14. The exterior portion of separator body 10 that has the grooves 16 and 18 is shown as a helical groove section 60

Figure 8:
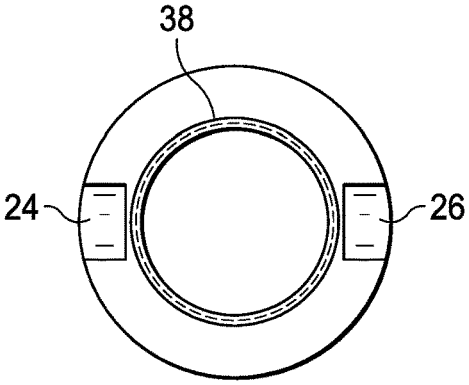
FIG. 8 is a bottom view of the separator body shown in FIGS. 1-4.

The separator body 10 is shown with a top view in FIG. 7 and with a bottom view in FIG. 8. In FIG. 7, the open end of groove 16 at the top is shown at a termination 56 and the open end of the groove 18 is at the termination 58.

As shown in FIGS. 1-6, slots 20 and 22 transfer fluid from chamber 52 to the helical grooves 16 and 18. Slots 24 and 26 transfer liquid from below the separator 10 into the upper chamber 54. Slots 24 and 26 and threads 38 are shown in the bottom view of the separator 10 in FIG. 8.

The separator body 10 can be formed or machined from a single block of material, for example metal or fiberglass, so that the body 10 is a unitary member, for example a unitary metal member.

Figure 9:
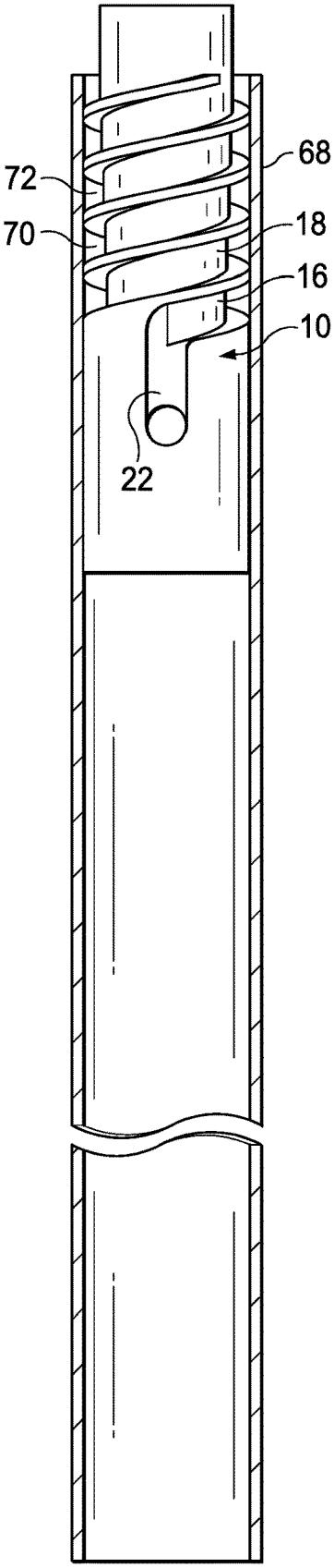
FIG. 9 is a partial section and side view of a separator body, as shown in FIGS. 1-4 together with a surrounding shroud.

A shroud 68 is shown in FIG. 9. The shroud 68 tightly encloses the separator body 10 such that the inner wall of the shroud 68 substantially closes the grooves 16 and 18 by contact to the outer surface of the outward extending wall of the grooves. This tight fit of the shroud 68 forms an outer wall for the grooves such that the groove 16, taken together with the inner wall of the shroud 68, forms a helical passageway 70. Likewise, the groove 18 taken together with the inner wall of the shroud 68 forms a helical passageway 72. The end openings of the passageways 70 and 72 are at the terminations 56 and 58 (FIG. 7). The shroud 68 can be tightly fitted to the separator body 10 by any of multiple techniques, including heat shrinking, force fit or by a joining such as by use of an adhesive. The shroud 68 is a tubular member which can be longer than the body 10.

The separator body 10 can be manufactured by a machine tool, a numerical control machine tool and can also be manufactured by use of 3-D printing. By using 3-D printing, the separator body 10 and shroud 68 can be manufactured as a single unit. However, it may be useful to manufacture the portion of the shroud 68 below the lower end of the separator body 10 as a separate unit which is then connected to the unitary separator body and shroud by means of threads, welding, press fit, glue or other metal working technique.

Possible working dimensions for the separator body 10 and the shroud 68 are as follows. The separator body 10 can have, for example, a length of 12 inches with the helical groove section 60 (FIG. 5) formed on approximately half of the length, that is 6 inches long. The body 10 is preferably circular with an outer diameter of 4 inches. The helical grooves surround a substantial portion of the second chamber 54. One possible length for the shroud 68 is 100 inches. An outer diameter of the shroud 68 can be 4.25 inches. The length of the helical groove section 60 is dependent on the nature of the fluid produced from the well. A length of 6 inches may be effective in certain wells. However, the composition of fluid that comes from a well formation can vary over time and vary from well to well. A longer helical groove may be needed for certain wells to achieve a high degree of gas separation. Therefore, the length of the helical groove section can be in the range of 6 inches up to approximately 5 feet, but even greater lengths may be needed in certain applications.

Figure 10:
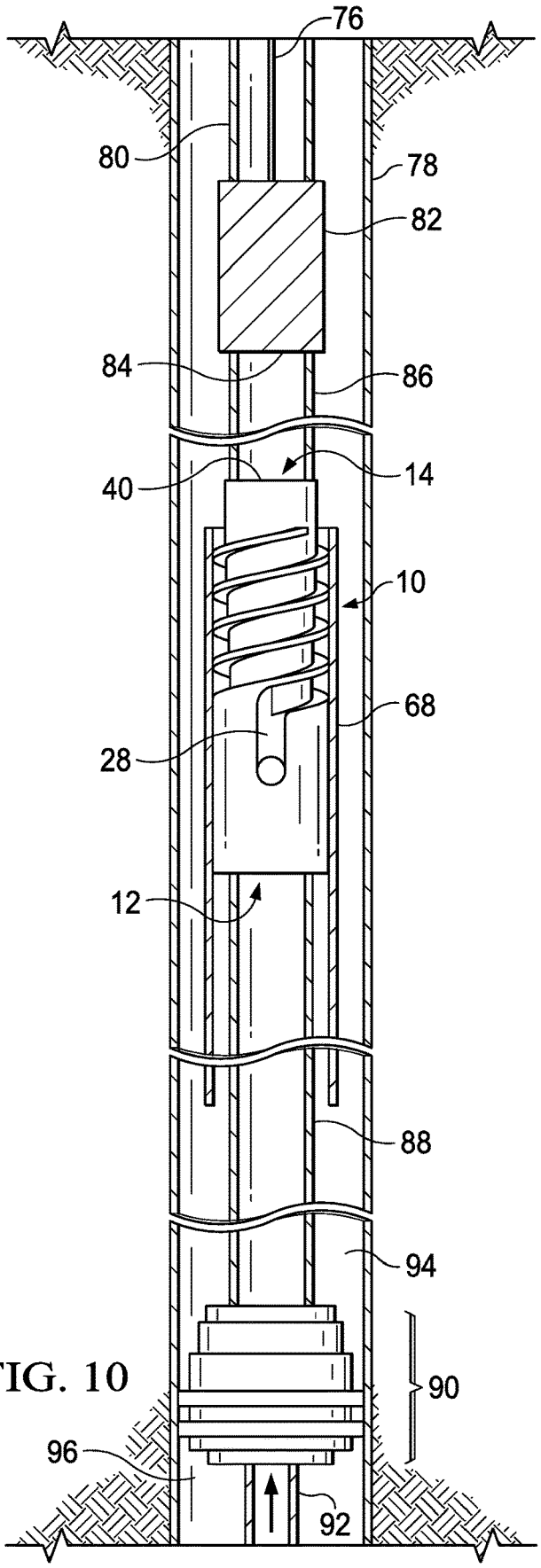
FIG. 10 is a partial section and side view (at 0 degree rotation) of a separator body, as shown in FIG. 1 together with a surrounding shroud installed in a wellbore having casing, a pump, tubing, a packing assembly and a tail pipe.

An illustration of the separator body 10 installed in a borehole is shown in FIG. 10. The borehole has casing 78 within which is installed tubing 80 extending downward to a pump 82. The pump 82 can be any one of many types, including a sucker rod pump, a positive displacement pump, or others. A sucker rod 76 can operate the pump 82. The pump 82 has an inlet 84. A section of tubing 86 is connected by threads at one end into the pump inlet 84 and by threads at the other end into the opening 40 to the internal threads 42 of the separator body 10. The shroud 68 is tightly fitted to the separator body 10.

Further referring to FIG. 10, the first end 12 of the separator body 10 is connected by the internal pipe threads 42 to a length of tubing 88. Tubing 88 extends down to and is connected to a packing assembly 90. A tail pipe 92 may be connected to the other (downhole) side of the packing assembly 90. The tail pipe 92, if used, can have a different diameter than the tubing 80 and 88. The tail pipe 92 can have a lesser diameter than that of tubing 80. The packing assembly 90 forms a pressure seal between an annulus region 94 above the packing assembly 90 and an annulus region 96 below the packing assembly 90.

Figure 11:
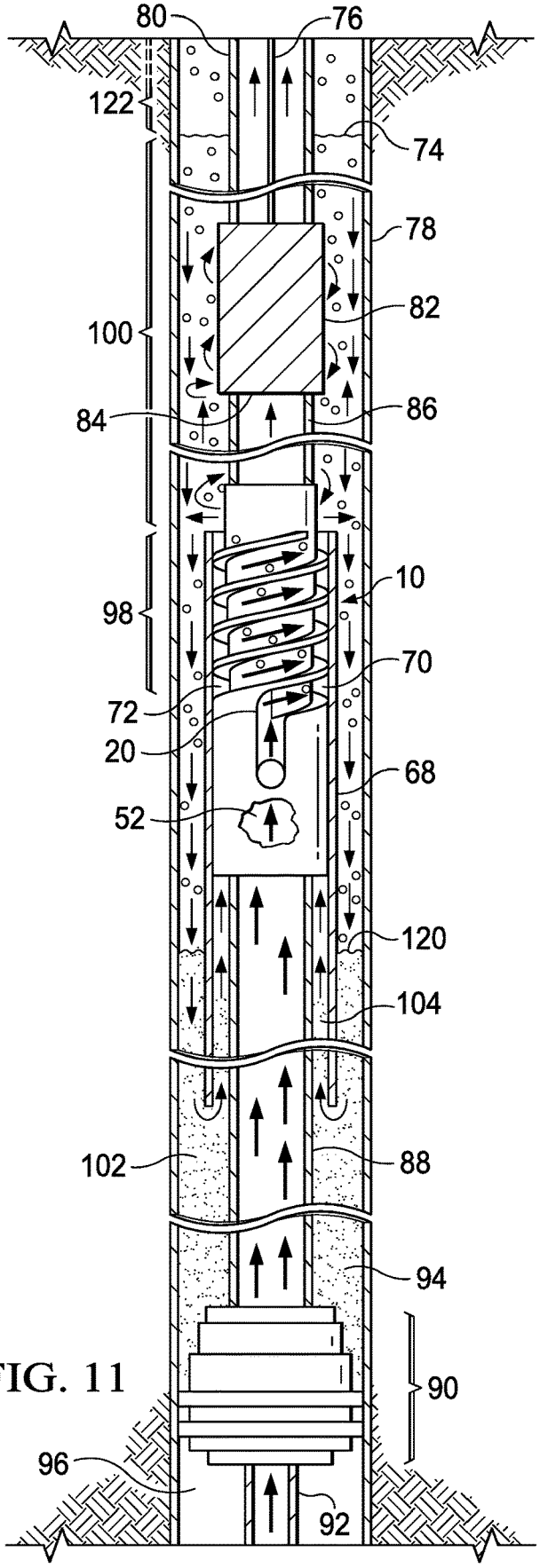
FIG. 11 is the partial section and side view of the structure shown in FIG. 10 illustrating a flow of fluid, gas and liquid through the system.

In reference to FIG. 11, there is shown the apparatus illustrated in FIG. 10 together with arrows to indicate the flow of fluid, liquid and gas from the tail pipe 92 to above the pump 82 within the casing 78 and tubing 80. The wide arrows represent the flow of fluid (gas-liquid mixture) and the thin arrows represent the flow of liquid. The small circles represent gas. The formation fluid is driven up through the packing assembly 90 or the tail pipe 92, through the center of the packing assembly 90, through the tubing 88 to the input opening at the lower end of the separator body 10 into the first chamber 52. The fluid passes out through a hole from the first chamber 52, through slot 20 into the helical passageway 70. The fluid also passes from the first chamber 52 out through a hole and through slot 22 (not shown in FIG. 11) into helical passageway 72. The helical passageways 70 and 72 are in a spiraling rotation zone 98 which at least partially surrounds the second chamber 54. The chamber 54 is within the separator body 10. As the fluid rotates in the zone 98, liquid in the fluid is forced outward by centrifugal force and lighter gas tends to accumulate inward, thus functioning to separate gas from the liquid within the channel.

Further referring to FIG. 11, the liquid and gas exit from the open ends of the passageways 70 and 72 into a separation zone 100, which extends from immediately above the spiraling rotation zone 98 to above the pump for a distance of a few feet or up to several hundred feet This distance is dependent on multiple factors including the specific gravity of the fluid, the gas pressure in the annulus, the production rate of the well, the specific tubing and casing dimensions, the liquid viscosity, and fluid and gas temperature. The liquid and gas are ejected from the helical passageways 70 and 72 at the terminations 56 and 58. The ejected liquid may still contain entrained gas. The liquids and gas are ejected into zone 100 outward with a tangential velocity. If there is a sufficient flow rate, this causes the liquids and gas to rotate and move further into the zone 100. This rotation further incurs centrifugal force which tends to separate the heavier liquids from the lighter gas. Even without rotation in zone 100, there can be further separation of liquid and gas. As shown with the thin arrows, the liquid drains downward due to gravity pull to a liquid reservoir 102. The separation of gas and liquids occurs in the spiraling rotation zone 98 and in the above separation zone 100. Further gas separation can occur in the reservoir 102. At a low liquids and gas flow rate, the liquids may exit from the terminations 56 and 58 and immediately dribble downward due to the pull of gravity. The gas flows up the well annulus. A substantial portion of the liquids flow downward on the interior wall of the casing 78.

Within the annulus between the casing 78 and the shroud 68 there is an interface 120 at the surface of the liquid reservoir 102 and the bottom of a gas-liquid mixture. The interface 120 is within the annulus between the outer surface of the shroud 68 and the interior wall of the casing 78. The height of the interface 120 in the well can vary due to changing flow rates from the formation.

The zone 100 contains gas, liquids and liquids with entrained gas. At the top of zone 100 is an interface 74. Above the interface 74, there is essentially only gas. This gas moves up the annulus to the well surface. Zone 122 is the region above the interface 74.

Further referring to FIG. 11, the liquid in reservoir 102 is driven by the pressure of the fluid above the reservoir 102 upward through an annulus 104 which is located between the outer wall of the tubing 88 and the inner wall of the shroud 68. The liquid moves upward and into the second chamber 54 (not shown in FIG. 11) of the separator body 10. This flow is described in more detail in reference to FIG. 12. The liquid is driven from the chamber 54 out of the separator body 10 through the tubing 86 and into the inlet of the pump 82. The pump 82 then drives the liquid up the tubing 80 to the well surface.

Figure 12:
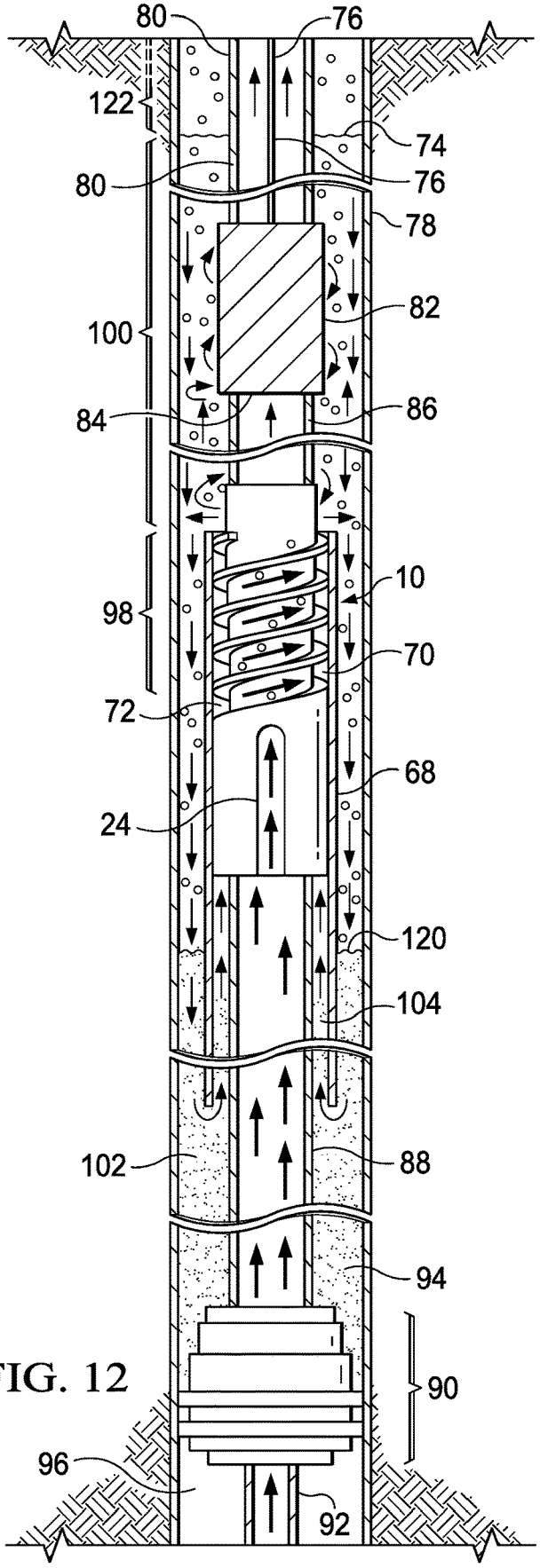
FIG. 12 is the partial section and side view of the structure shown in FIG. 10 illustrating the flow of fluid, gas and liquid through the system with the separator body rotated 90 degrees from that shown in FIG. 11.

Referring to FIG. 12, there is shown the same apparatus as in FIG. 11, but viewed with a rotation of 90 degrees to illustrate additional liquid flow. The fluid is driven upward through the tubing 88 into the slots 24 and 26 (see FIGS. 2 and 4) into the second (upper) chamber 54 of the separator body 10. The shroud 68 inner wall covers the slots 24 and 26 at the outer opening thereof to form channels for the liquid flow. The separated liquid is collected by gravity drainage into the reservoir 102 and driven by the pressure of the overlying fluid up through the slots 24 and 26 into the second chamber 54 and from this chamber to the pump 82 inlet.

Figure 13:
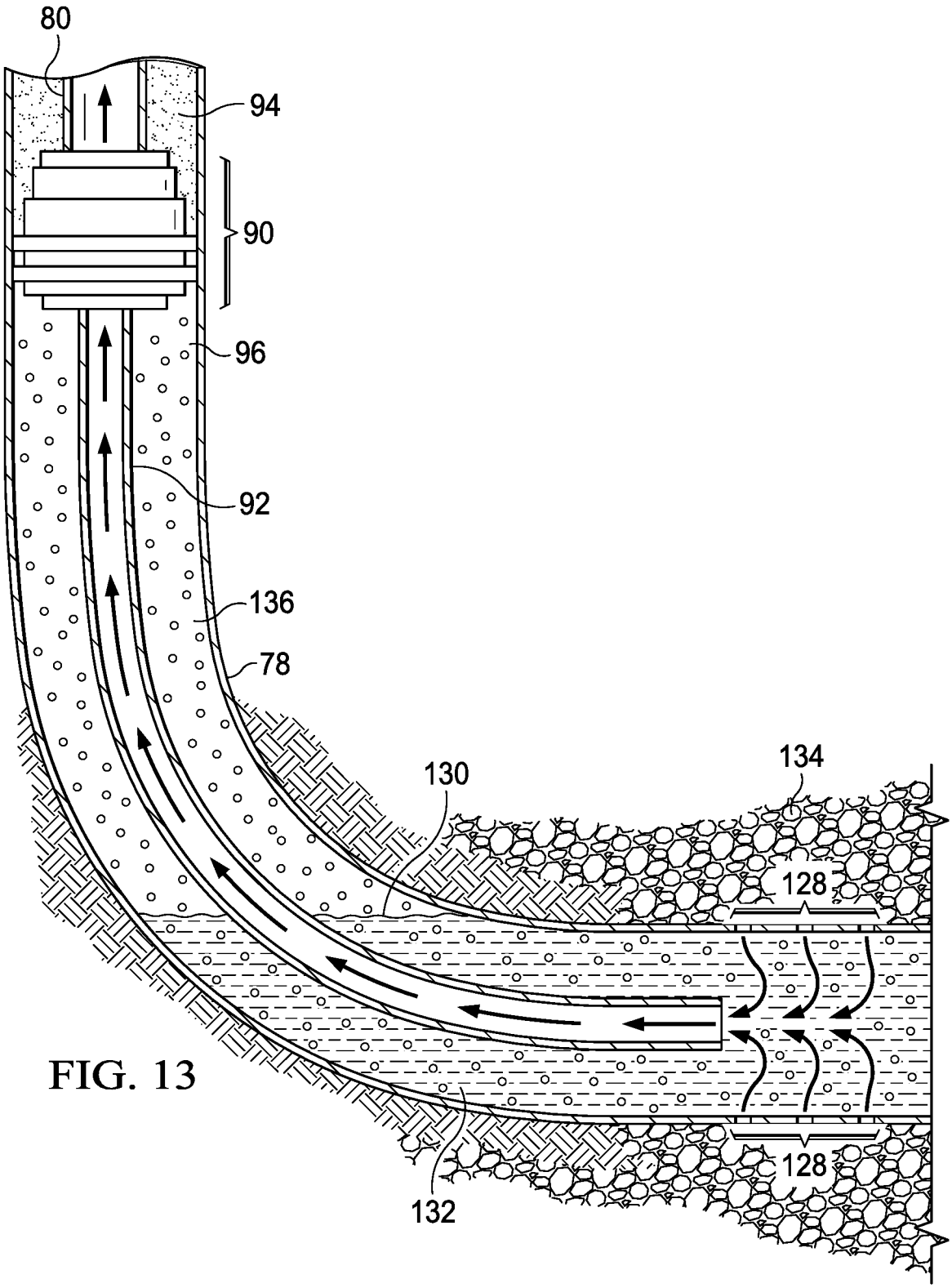
FIG. 13 is a section and side view of the lower end of the structure shown in FIG. 11, including a tail pipe curved into a horizontally drilled portion of a well borehole.

FIG. 13 shows the lower end of the structure illustrated in FIGS. 11 and 12 with an extension of the casing 78 and the tail pipe 92. This shows the use of the apparatus shown in the preceding figures in a well in which the borehole has been curved by approximately 90 degrees to a horizontal direction. The formation fluid enters the casing 78 through perforations 128 and forms a reservoir 132. The surface of the reservoir 132 is an interface 130. Gas may be present above the interface 130 up to the packing assembly 90. The casing 78 is surrounded by rock 134. The formation fluid is driven upward through the tail pipe 92 to the separator body 10, as described above. The fluid receiving open end of the tail pipe 92 can be located at any one of multiple positions in the wellbore. If it is in the horizontal portion of the wellbore, as shown in FIG. 13, this is termed 0 degrees. The angle designation increases up to 90 degrees, which is vertical. The open end of the tail pipe 92 could, for example, be at the 60 degree position, which is in curved part of the wellbore. The apparatus described herein is likewise applicable to a borehole that is drilled only vertically.

The gas separator 10 embodiment shown in FIGS. 1-13 has two intertwined helical passageways. However, a gas separator as described herein can have one or more than two of such passageways and the length, as noted above, can vary depending on the well in which it is used. The grooves and channels, however, should be large enough so as to not unduly restrict the flow of liquid and gas.

Figure 14:
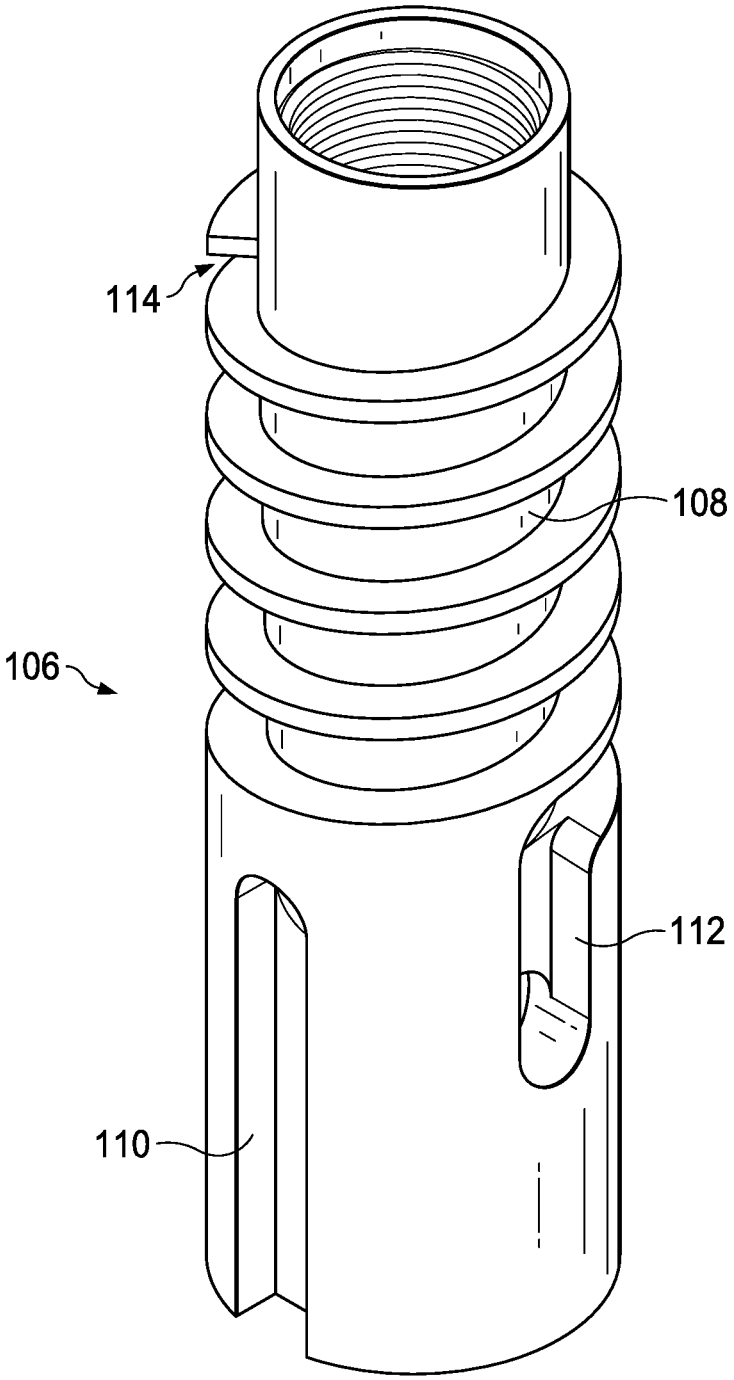
FIG. 14 is an off normal side view (top tilted toward the viewer) of a second embodiment of a separator body showing a side and the top.

An embodiment of a separator body with only one helical passageway is shown in FIG. 14. A separator body 106 has a single helical passageway 108 and has the same interior structure with first and second chambers as described previously for separator body 10. The well fluid is directed from the lower chamber through a slot 112 to the helical passageway 108. The separated liquid is driven through a slot 110 into the second (upper) chamber and from this chamber to the inlet of the pump 82. The embodiment using separator body 106 can be substituted for the separator body 10 described in the preceding figures. The shroud 68 is similarly fitted about the separator body 106. The separator body 106 can likewise be machined from a single block of metal so that the body 106 is a unitary metal member or manufactured as described above for separator body 10.

The gas separator hardware and methods of operation described herein can be utilized with wells which have only a vertical borehole and with wells which have vertical, inclined, deviated and horizontal borehole sections.

Although several embodiments of the invention have been illustrated in the accompanying drawings and described in the foregoing Detailed Description, it will be understood that the invention is not limited to the embodiments disclosed but is capable of numerous rearrangements, modifications and substitutions without departing from the scope of the invention.

What is claimed is:

1. A downhole gas separator for use in hydrocarbon production for separating gas from liquid, comprising:

an elongate separator body having first and second ends, an exterior portion and an outer surface, a barrier inside said separator body forming a first interior chamber having a portion thereof proximate said first end and a second interior chamber having a portion thereof proximate said second end, said separator body having an opening through said first end into said first chamber and an opening through said second end into said second chamber, an elongate shroud having an inner wall and encompassing a majority length of said separator body with the outer surface of said separator body contacting the inside wall of said shroud, a helical groove positioned in the exterior portion of said separator body, said helical groove and the inner wall of said shroud forming a helical passageway that extends around at least a portion of said second chamber, said helical passageway having an open end proximate said second end of said separator body, a first slot in the exterior portion of said separator body, said first slot forming with the inner wall of said shroud a first channel extending from said first chamber and opening into said helical passageway, and a second slot in the exterior portion of said separator body, said second slot forming with the inner wall of said shroud a second channel extending from proximate said first end of said separator body into said second chamber.

2. A downhole gas separator as recited in claim 1 further including threads on an interior surface of said separator body proximate said first opening and threads on an interior surface of said separator body proximate said second opening.

3. A downhole gas separator as recited in claim 1 wherein said separator body has a circular cross section and said shroud has a circular cross section.

4. A downhole gas separator as recited in claim 1 wherein said shroud is longer than said separator body.

5. A downhole gas separator as recited in claim 1 wherein said separator body is a unitary metal member.

6. A downhole gas separator as recited in claim 1 wherein said separator body and said shroud are a unitary metal member.

7. A downhole gas separator for use in hydrocarbon production for separating gas from liquid, comprising:

an elongate separator body having first and second ends, an exterior portion and an outer surface, a barrier inside said separator body forming a first interior chamber having a portion thereof proximate said first end and a second interior chamber having a portion thereof proximate said second end, said separator body having an opening through said first end into said first chamber and an opening through said second end into said second chamber, an elongate shroud having an inner wall and encompassing a majority length of said separator body with the outer surface of said separator body contacting the inside wall of said shroud, a first helical groove positioned in the exterior portion of said separator body, said helical groove and the inner wall of said shroud forming a first helical passageway that extends around at least a portion of the second chamber, said first helical passageway having an open end proximate said second end of said separator body, a second helical groove positioned in the exterior region of said separator body, said second helical groove and the inner wall of said shroud forming a second helical passageway that extends around at least a portion of the second chamber, said second helical passageway having an open end proximate said second end of said separator body, a first slot in the exterior portion of said separator body, said first slot forming with the inner wall of said shroud a first channel extending from said first chamber and opening into said first helical passageway, a second slot in the exterior portion of said separator body, said second slot forming with the inner wall of said shroud a second channel extending from said first chamber and opening into said second helical passageway, a third slot in the exterior portion of said separator body, said third slot forming with the inner wall of said shroud a third channel extending from proximate said first end of said separator body into said second chamber, and a fourth slot in the exterior portion of said separator body, said fourth slot forming with the inner wall of said shroud a fourth channel extending from proximate said first end of said separator body into said second chamber.

8. A downhole gas separator as recited in claim 7 further including threads on an interior surface of said separator body proximate said first opening and threads on an interior surface of said separator body proximate said second opening.

9. A downhole gas separator as recited in claim 7 wherein said separator body has a circular cross section and said shroud has a circular cross section.

10. A downhole gas separator as recited in claim 7 wherein said shroud is longer than said separator body.

11. A downhole gas separator as recited in claim 7 wherein said separator body is a unitary metal member.

12. A downhole gas separator as recited in claim 7 wherein said separator body and said shroud are a unitary metal member.

13. A method for downhole separation of gas from liquid in a hydrocarbon producing well having a pump which draws fluid from a formation and forces liquid, having gas at least partially separated therefrom, up through tubing to the well surface, comprising the steps of:

driving formation fluid up through a tail pipe inlet of a tail pipe and out into a first chamber, said first chamber located below said pump, the driving of said formation fluid due to a pressure difference between the tail pipe inlet and said first chamber, driving said fluid from said first chamber into a spiraling fluid rotation zone, wherein centrifugal force produced by the spiraling rotation of said fluid drives liquid laterally outward to at least partially separate the liquid from the gas in the fluid, said spiraling rotation zone at least partially surrounding a second chamber, and then ejecting the liquid and the gas from said spiraling fluid rotation zone into an annulus region above said second chamber, after said liquid is ejected from said spiraling rotation zone, draining said liquid downward by gravity flow into an annulus reservoir located below said spiraling rotation zone, driving said liquid from said annulus reservoir into said second chamber, which is positioned above said first chamber, the driving of said liquid due to a pressure difference between fluid above said annulus reservoir and said second chamber, and driving said liquid from said second chamber into an inlet of said pump due to a pressure difference between said second chamber and the inlet to said pump.

14. A method for downhole separation of gas from liquid as recited in claim 13 including the step of driving said formation fluid through channels exterior to said first chamber into said spiraling rotation zone.

15. A method for downhole separation of gas from liquid as recited in claim 13 including the step of driving said liquid upward through an annulus and then through channels, which are exterior to said first chamber, into said second chamber.

16. A method for downhole separation of gas from liquid as recited in claim 13 wherein said fluid in said spiraling rotation zone travels along a helical pathway.

* * * * *